US006029833A

United States Patent [19]

Yeh

[11] Patent Number: 6,029,833

[45] Date of Patent: Feb. 29, 2000

[54] CLOTHES DISPLAY RACK

[76] Inventor: Kuo-Huei Yeh, No. 18, Alley 46, Lane 9, Shin Shing Road, Pei Tun, Tai Chung City, Taiwan

[21] Appl. No.: 09/160,589

[22] Filed: Sep. 25, 1998

[51] Int. Cl.[7] ..... A47F 5/00

[52] U.S. Cl. ..... 211/189; 211/187; 211/105.1; 211/90.01; 108/108

[58] Field of Search ..... 211/189, 187, 211/150, 105.1, 90.01, 103, 193, 191, 192, 134, 182; 108/108, 107

[56] References Cited

U.S. PATENT DOCUMENTS

| | | | |
|---|---|---|---|
| 3,018,900 | 1/1962 | Huet | 211/193 X |
| 3,297,374 | 1/1967 | Radek | 108/108 X |
| 3,830,374 | 8/1974 | Kassimir | 211/134 X |
| 3,856,148 | 12/1974 | Olinick | 108/108 X |
| 3,865,250 | 2/1975 | Jay | 211/182 X |
| 3,877,395 | 4/1975 | Sobel | 108/108 X |
| 3,990,582 | 11/1976 | Schindel | 211/105.1 |
| 4,150,753 | 4/1979 | Stahl et al. | 211/105.1 |
| 4,316,546 | 2/1982 | Varon et al. | 211/105.1 |
| 4,316,547 | 2/1982 | Varon | 211/105.1 |
| 4,380,298 | 4/1983 | Harig | 211/189 |
| 4,501,369 | 2/1985 | Fox | 211/187 X |
| 4,730,739 | 3/1988 | Semerau, Jr. | 211/187 X |
| 5,052,565 | 10/1991 | Zachrei | 211/182 |
| 5,310,066 | 5/1994 | Konstant | 211/187 X |
| 5,377,851 | 1/1995 | Asano et al. | 211/189 X |
| 5,437,116 | 8/1995 | Hardy | 211/193 X |
| 5,452,812 | 9/1995 | Niequist et al. | 211/187 |
| 5,605,239 | 2/1997 | De Voursney et al. | 211/182 X |
| 5,607,070 | 3/1997 | Hellyer | 211/189 |
| 5,690,239 | 11/1997 | Ballard | 211/189 |
| 5,803,273 | 9/1998 | Menaged et al. | 211/105.1 X |
| 5,820,289 | 10/1998 | Kern et al. | 211/182 X |

*Primary Examiner*—Daniel P. Stodola
*Assistant Examiner*—Khoa Tran
*Attorney, Agent, or Firm*—Dougherty & Troxell

[57] ABSTRACT

A clothes display rack which has simplified structure and can be practically used in different manners for holding or hanging clothes or other articles. The display rack mainly includes two side posts, a display frame, and two supporting bars. When the display rack is used together with supporting arms, display panels, hangers and hooks, it can provide multiple functions and presents different appearances to meet the user's actual need and the dimensions of display places.

9 Claims, 12 Drawing Sheets

CLOTHES DISPLAY RACK

BACKGROUND OF THE INVENTION

The present invention relates to a clothes display rack structure, and more particularly to a multi-function display rack which has simplified structure and can be practically used in different manners for holding or hanging clothes or other articles.

Most display racks used in general department stores and exhibitions have various designs and configurations to meet different requirements. However, these display racks usually have a complicated structure while they provide only limited functions. In the nowaday commercial society, it is very important for the businesses to display their products in a new and novel manner so as to lead the fashion. To effectively attract general consumers, the businesses have to spend a lot of time and make efforts to design their display racks to always present a completely new image. It is therefore tried by the inventor to develop a flexible display rack which can be assembled in different manners to provide various kinds of display spaces while it has very simple structure.

SUMMARY OF THE INVENTION

A primary object of the present invention is to provide a clothes display rack which has simple structure while it is highly stable and is changeable in its functions for holding and hanging clothes and other articles. The display rack can be freely assembled to provide one single or two display sides to meet the actual need of user.

Another object of the present invention is to provide a clothes display rack which mainly includes side posts and display frames. The side posts and display frames may work together with a plurality of supporting arms and holding panels to form a rack suitable for laying clothes on the holding panels, or with horizontal bars provided on the side posts to hold hangers for hanging clothes or articles.

A further object of the present invention is to provide a clothes display rack which is provided with a set of height-adjustable holding members so that longer articles or clothes can be hung on hooks or hangers on the holding members assembled to higher positions on the display rack.

A still further object of the present invention is to provide a clothes display rack which includes supporting bars which allow the side posts to connect thereto at different positions, so as to form a one-side or two-side display rack to meet actual needs in different showrooms.

BRIEF DESCRIPTION OF THE DRAWINGS

The structure and functions of the present invention can be best understood by referring to the following detailed description of the preferred embodiment and the accompanying drawings, wherein.

DETAILED DESCRIPTION OF THE PREFERRED EMBODIMENTS

Figure 1:
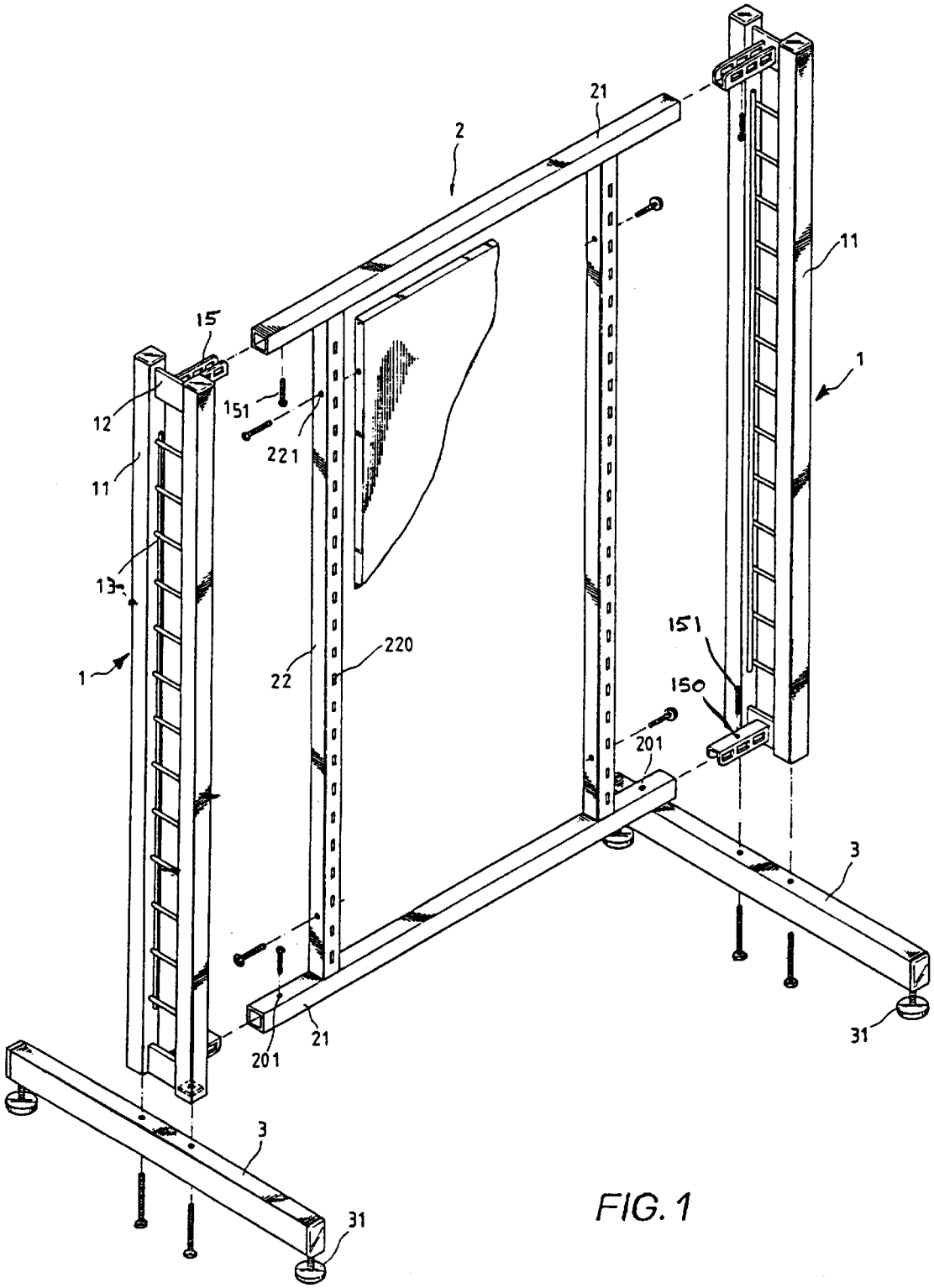
FIG. 1 is an exploded perspective showing a basic structure of the present invention.
Figure 2:
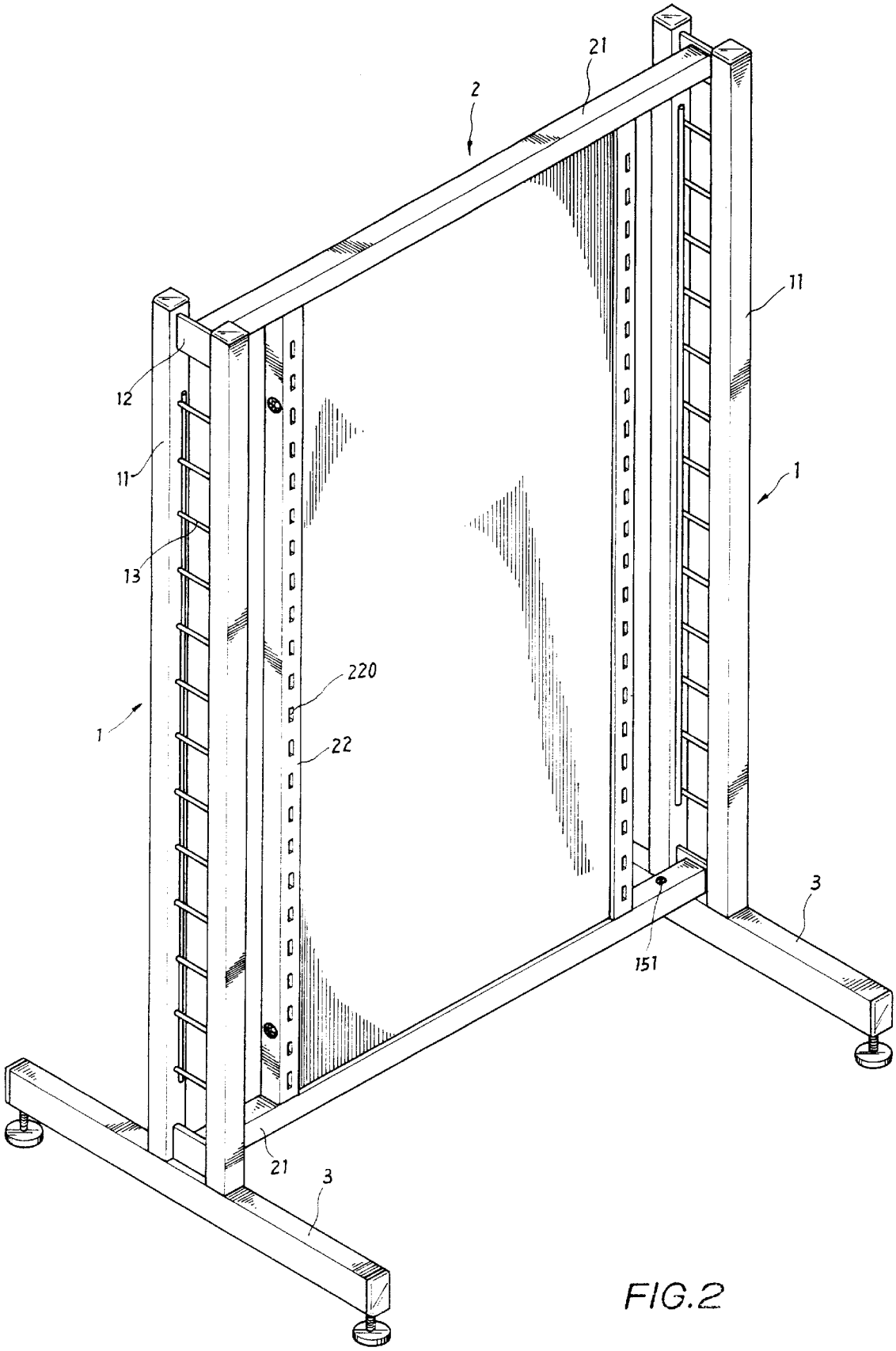
FIG. 2 is a perspective showing a basic form of the present invention in an assembled state.

Please refer to FIGS. 1 and 2. The present invention relates mainly to a clothes display rack which provides changeful display spaces while it has very simple structure.

The clothes display rack according to the present invention mainly includes two side posts 1, a display frame 2 and two supporting bars 3.

Each of the side posts 1 includes two vertically and parallelly extended members 11 and two connection boards 12 fixedly welded to extend between upper and lower ends of the two vertical members 11 of each side post 1, so that an elongated middle space is framed in the side post 1. A plurality of discrete crossbars 13 are sequentially and parallelly arranged in the middle space of the side post 1. A U-shaped bracket 15 having a screw hole 150 formed on a back portion thereof is fixed to a central point of each connection board 12, such that the back portions of the U-shaped brackets 15 at the upper and the lower ends of the side post 1 face each other.

Figure 3:
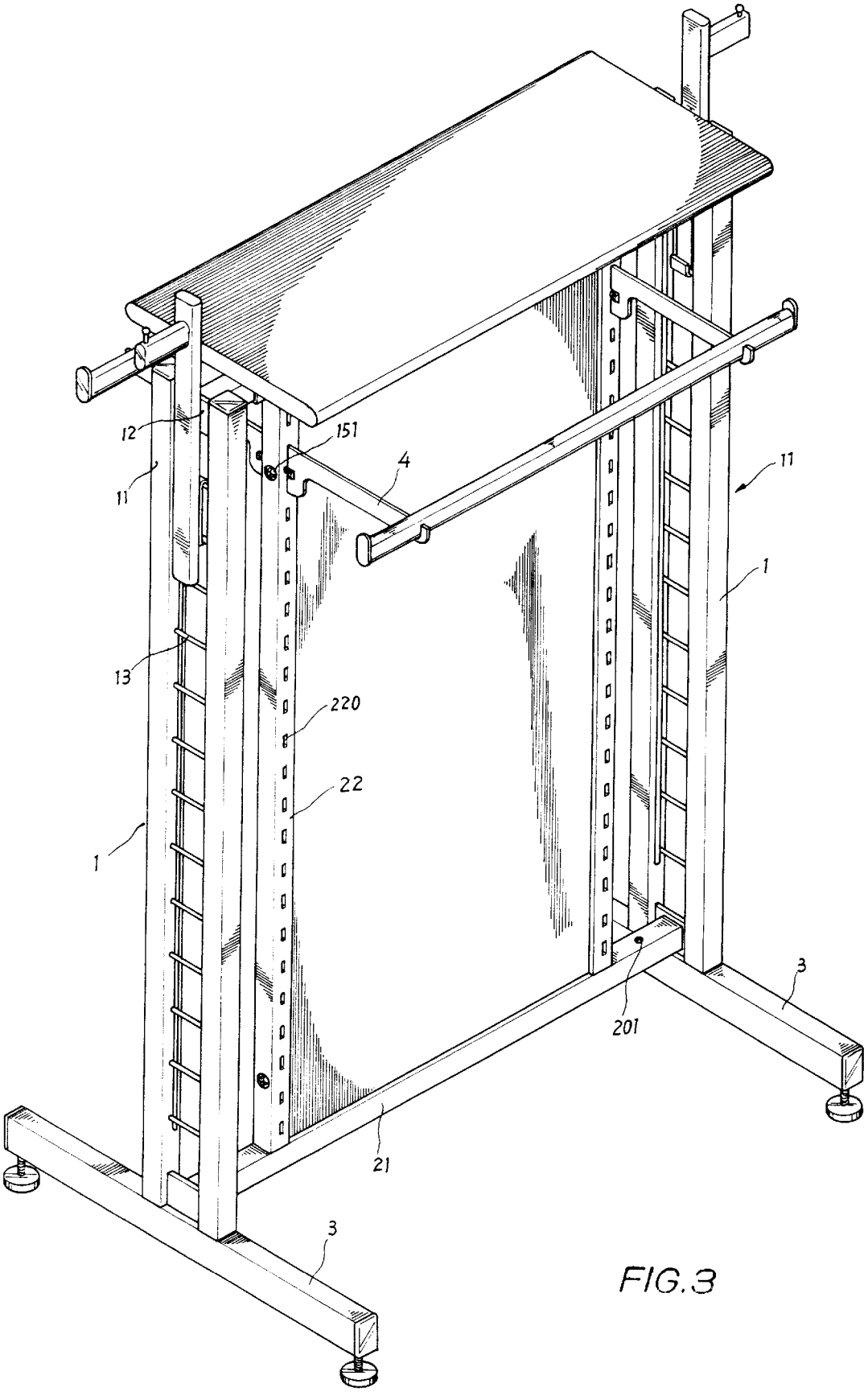
FIG. 3 illustrates the present invention with a wooden panel assembled to and set in the display frame of the present invention.
Figure 4:
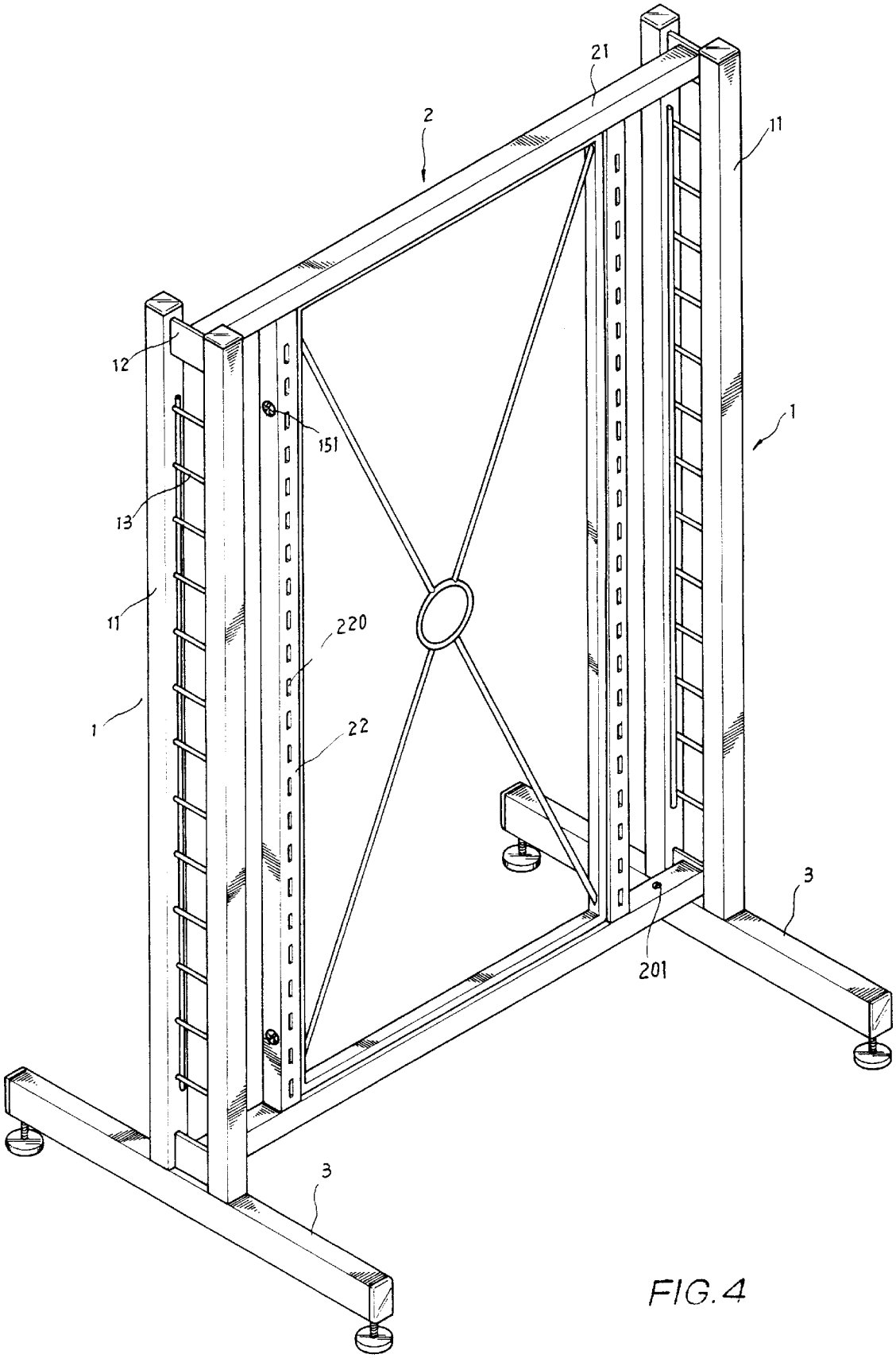
FIG. 4 illustrates the present invention with a screen assembled to and set in the display frame of the present invention.

The display frame 2 includes a top and a bottom horizontal beams 21 and two side supports 22. The horizontal beam 21 each has two hollow ends. These hollow ends have inner dimensions slightly larger than external dimensions of the U-shaped brackets 15, such that free ends of the brackets 15 are allowed to insert into the hollow ends of the horizontal beams 21. Screw holes 201 are provided on each horizontal beam 21 near two ends of a surface thereof facing the other horizontal beam 21, so that screws 151 can be threaded through the holes 201 on the beams 21 and holes 150 on the brackets 15 to lock the U-shaped brackets 15 to the horizontal beams 21. The side support 22 each has been punched at a front and a rear surface to form a plurality of openings 220 for each detachably receiving a supporting arm 4 therein. Round through holes 221 are formed on each side support 22 along two side surfaces thereof, so that a wooden panel or screen can be fixedly mounted in a space defined by the horizontal beams 21 and the side supports 22 by threading screws through holes 221 and into the wooden panel or screen, as shown in FIGS. 3 and 4. With the wooden panel or screen mounted in the display frame 2, the display frame 2 can be reinforced and beautified.

The supporting bar 3 each is a horizontally extended long member and has two height-adjustable legs 31 connected to a bottom surface thereof. The side posts 1 can be vertically mounted on a top surface of the supporting bars 3 at suitable positions either near two ends or in a middle portion thereof.

Figure 5:
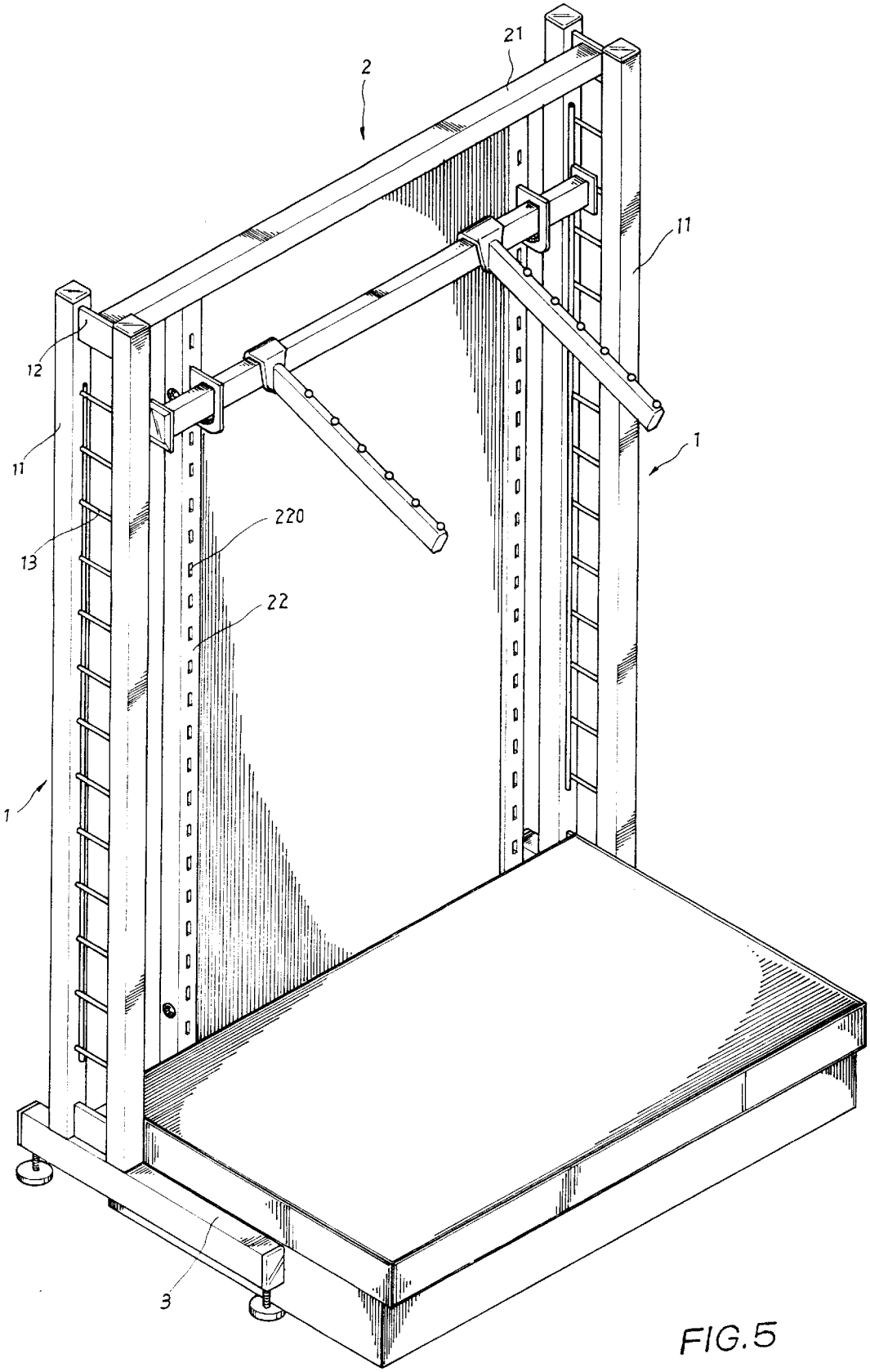
FIGS. 5 and 6 illustrate the present invention with only one display side formed on the rack.
Figure 6:
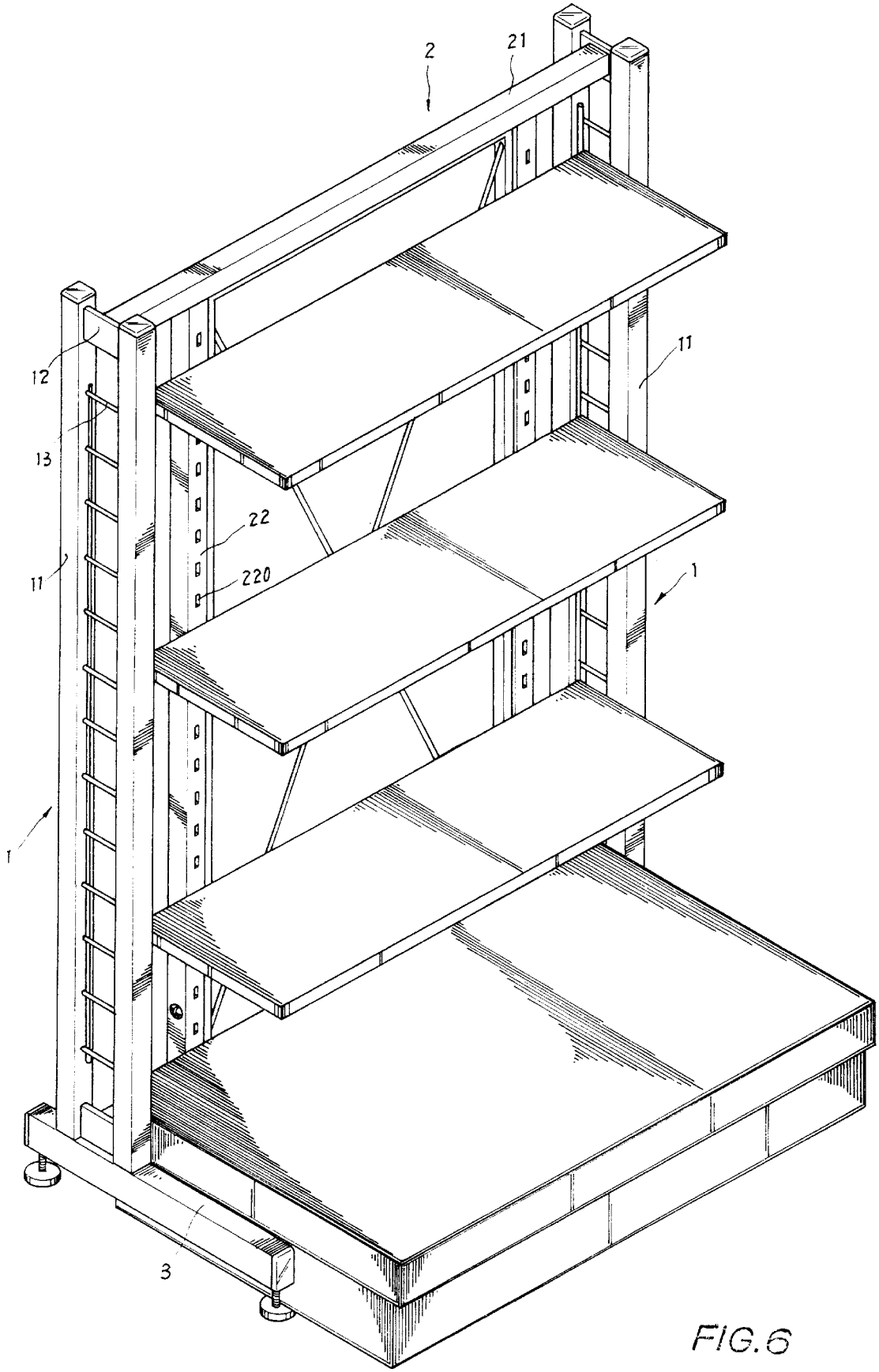
Figure 7:
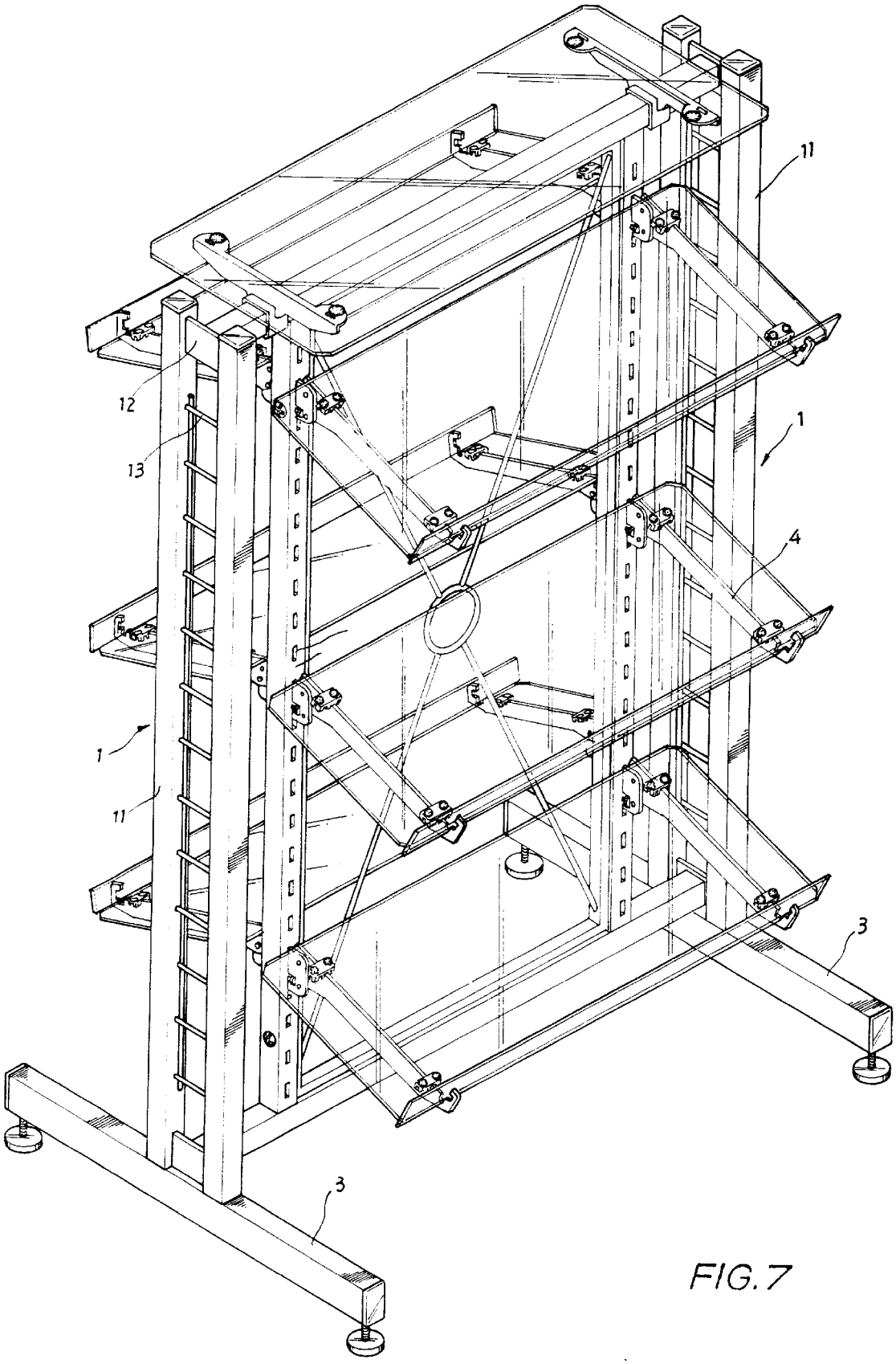
FIGS. 7, 8, 9, and 10 illustrate the present invention with two display sides formed on the rack.

To erect the whole display rack of the present invention, first erect the two side posts 1 on the two supporting bars 3 at desired positions. FIGS. 5 and 6 separately illustrate a display rack that has two side posts 1 mounted near one end of the supporting bars 3, so that the assembled display rack shall have only one display side. FIGS. 7, 8, 9 and 10 separately illustrate a display rack that has two side posts 1 mounted near a middle portion of the supporting bars 3, so that the assembled display rack shall have two display sides. The crossbars 13 of the side posts 1 can be used to hold general hooks or hangers for clothes or articles to hang thereto.

Figure 8:
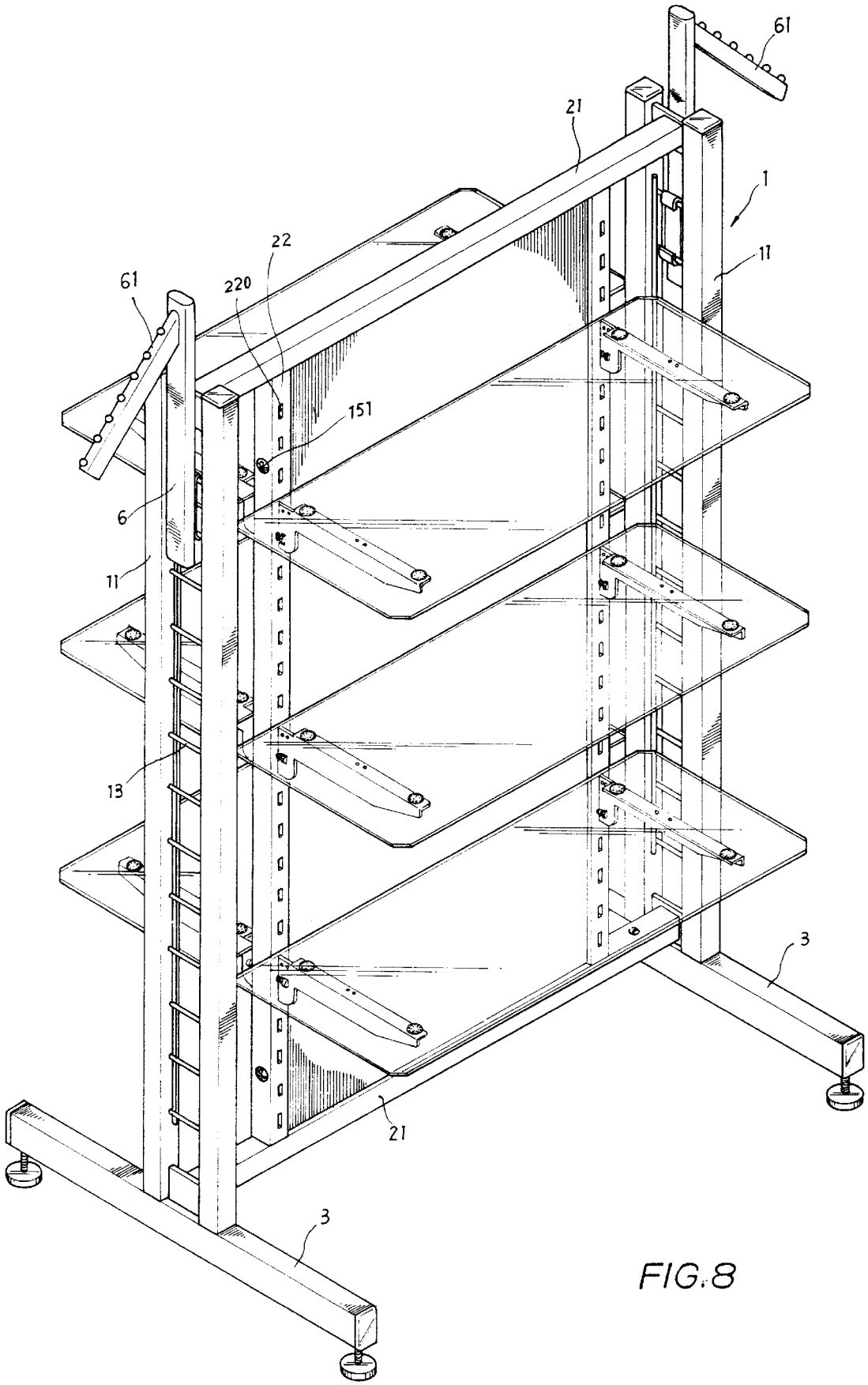
Figure 9:
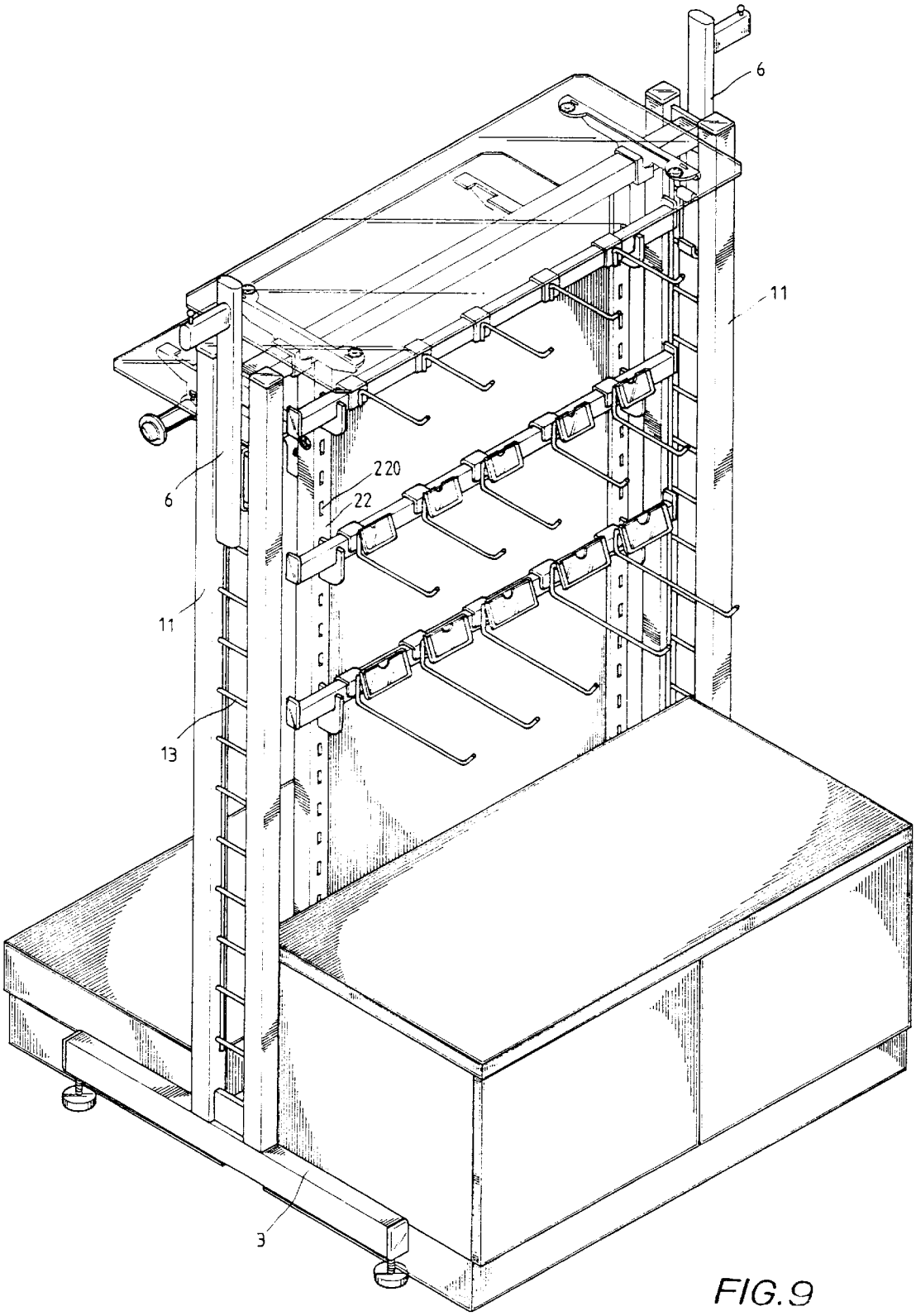
Figure 10:
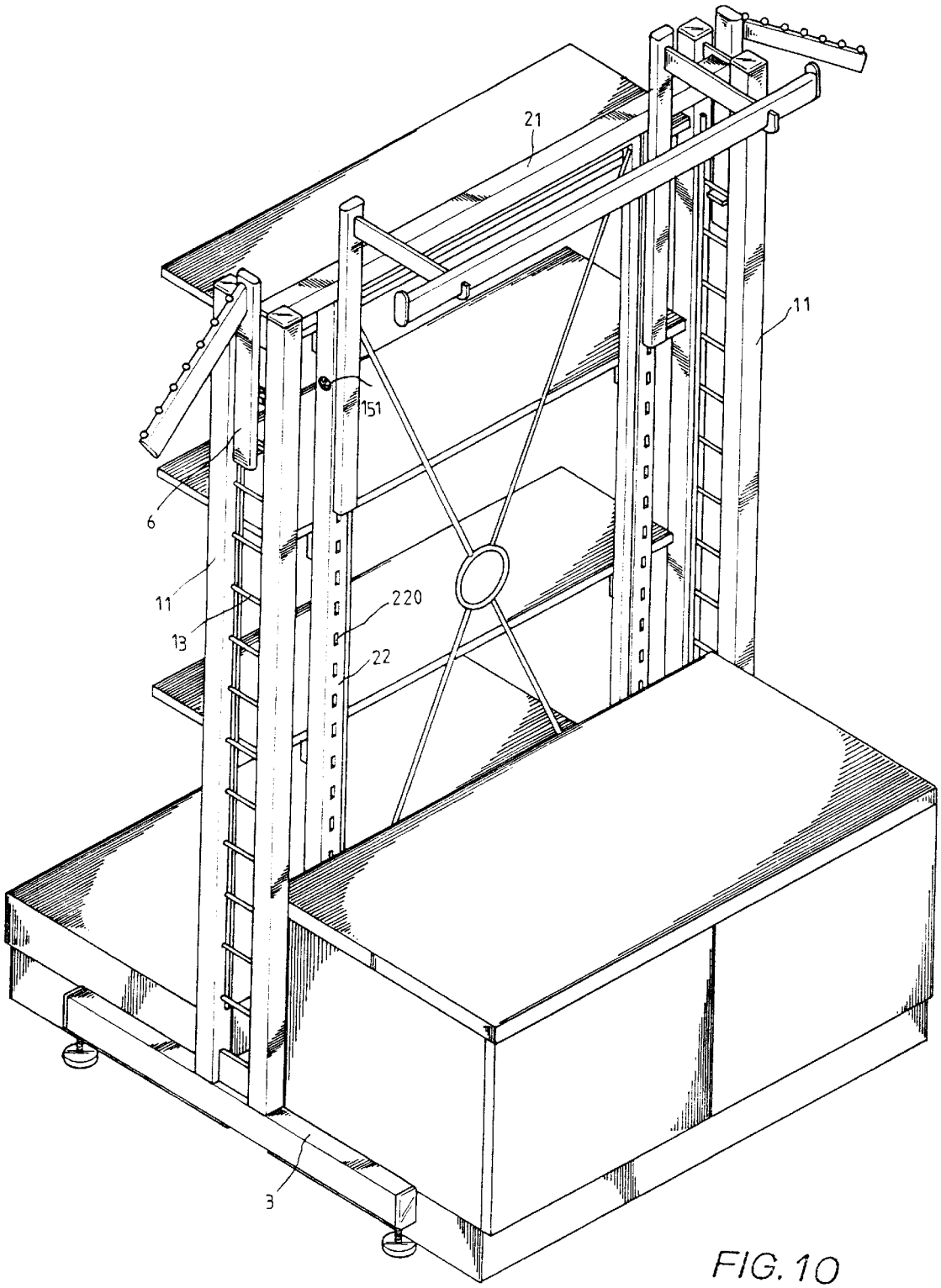

As shown in FIG. 8, an optional holding member 6 having an extended hanging bar 61 can be freely connected to the connection board 12 of the side post 1 at different heights, so that longer clothes or articles to be displayed, such as gowns, overcoats, suits, etc., can be hung on the holding member 6.

Figure 11:
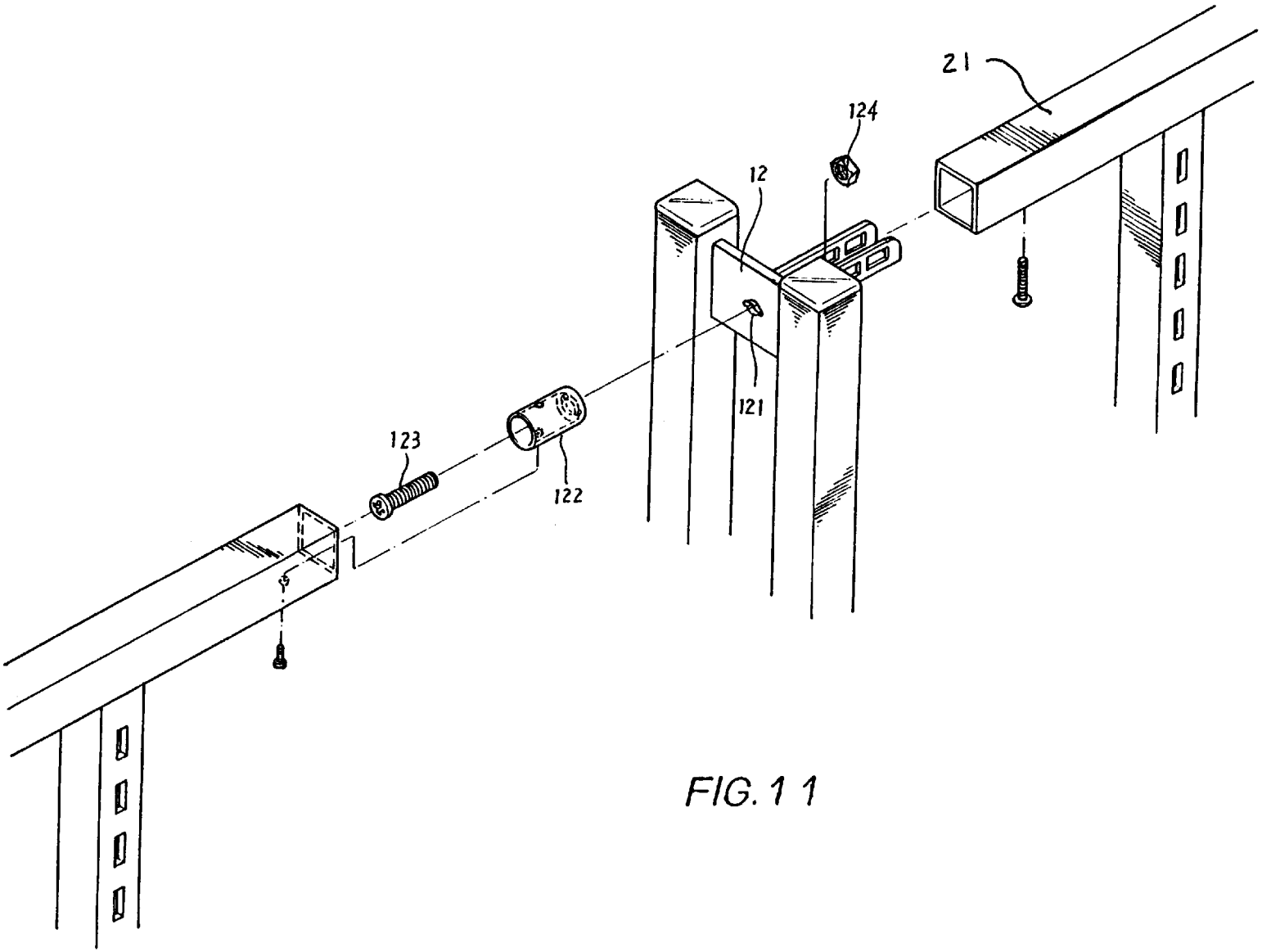
FIG. 11 is an exploded perspective showing the manner in which the present invention is sideward extended.
Figure 12:
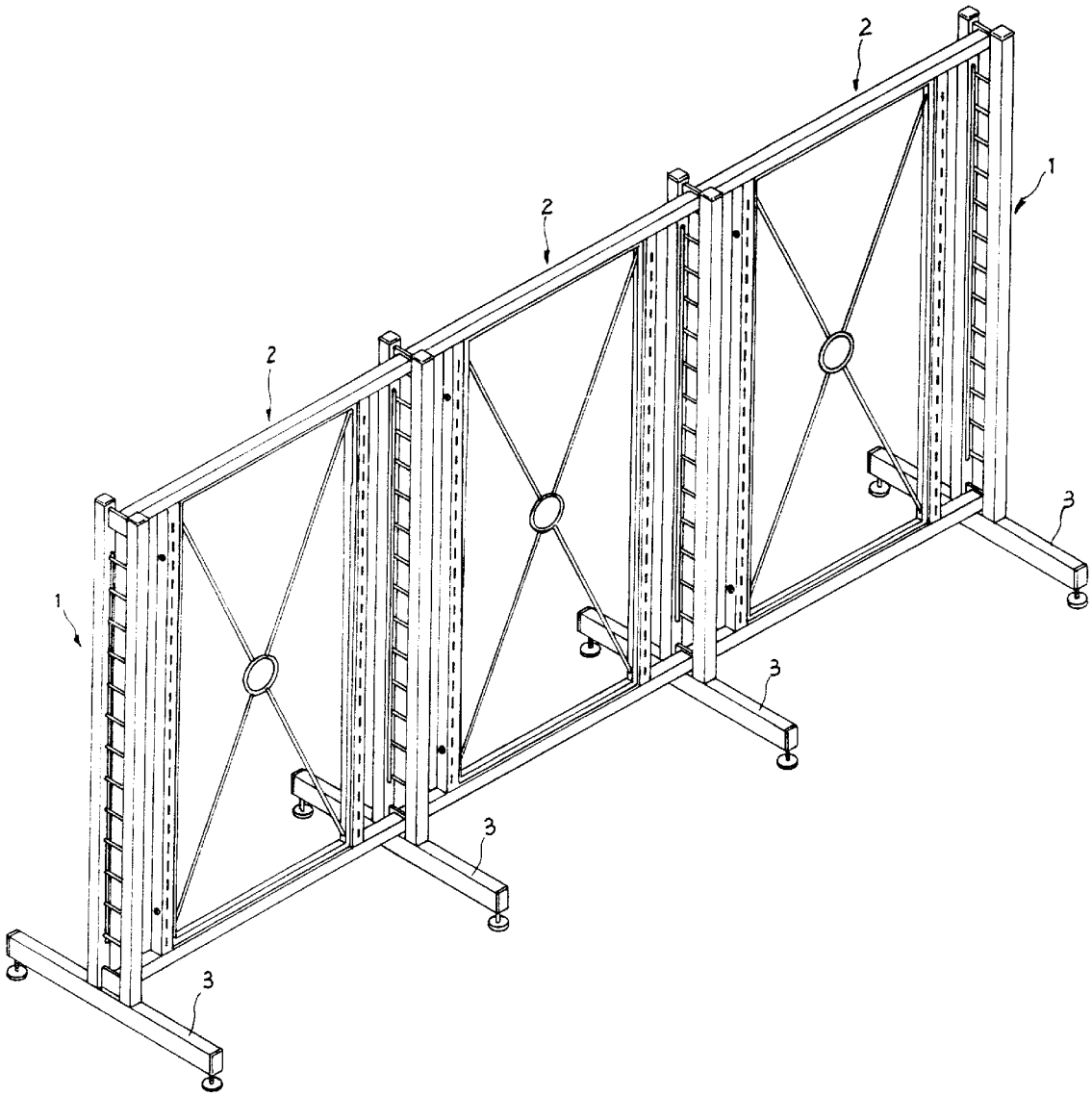
FIG. 12 is a perspective showing an embodiment of the present invention which has been sideward extended.

Please refer to FIGS. 11 and 12 now. The connection board 12 can be provided with a central bore 121, so that a sleeve 122 can be locked to the connection board 12 by threading a bolt 123 through the sleeve 122 and the central bore 121 to receive a nut 124 at the other side of the connection board 12. Then, a second set of the display rack can be attached to one side of a first display rack by threading screws through the horizontal beams 21 and the sleeves 122 already screwed to the connection boards 12 of the first display rack. By this way, the display rack can be extended in sideward direction as desired.

With the above arrangements, the clothes display rack of the present invention can be used for placing and hanging clothes and other articles. Moreover, the display rack can be differently assembled to provide either one or two display sides to meet different display requirements at different places.

What is claimed is:

1. A clothes display rack comprising:

a) first and second side posts, each side post having two spaced apart, parallel, elongated members, upper and lower connection boards connecting the two elongated members at upper and lower portions, respectively, a plurality of parallel crossbars disposed between the upper and lower connection boards and connecting the two elongated members together, and a supporting bar mounted on the lower portion of the two elongated members;

b) a display frame having top and bottom horizontal beams connected by two, spaced apart side supports, the side supports being spaced inwardly from ends of the top and bottom horizontal beams; and, c) brackets releasably attaching ends of the top and bottom horizontal beams to the upper and lower connection boards of the first and second side posts such that the two side supports are spaced from and out of contact with the first and second side posts, wherein the brackets have U-shaped cross-sectional configurations, each bracket being fixedly attached to a connection board and slidably engaging a respective end of the top and bottom horizontal beams.

2. The clothes display rack of claim 1, wherein at least one face of each of the two side supports has a plurality of openings for detachably receiving a supporting arm therein.

3. The clothes display rack of claim 1, further comprising a panel having opposite side edges, the panel attached to and located between the two side supports such that the opposite side edges are spaced inwardly from the first and second side posts.

4. The clothes display rack of claim 1, further comprising a screen panel having opposite side edges the screen panel attached to and located between the two side supports such that the opposite side edges are spaced inwardly from the first and second side posts.

5. The clothes display rack of claim 1, further comprising at least one extended hanging bar attached to at least one side post.

6. The clothes display rack of claim 1, wherein the side posts are mounted on the supporting bars at approximately mid-points of the supporting bars.

7. The clothes display rack of claim 6, wherein opposite faces of each of the side supports have a plurality of openings for detachably receiving a supporting arm therein.

8. The clothes display rack of claim 1, wherein the side posts are mounted on the supporting bars adjacent to an end of each supporting bar.

9. The clothes display rack of claim 1, further comprising:

a) a third side post having two spaced apart, parallel, elongated members, upper and lower connection boards connecting upper and lower portions of the elongated members, a plurality of parallel crossbars disposed between the upper and lower connection boards and connecting the two elongated members together, and a support bar mounted on the lower portions of the two elongated members;

b) a second display frame having top and bottom second horizontal beams connected by two spaced apart second side supports, the second side supports being spaced inwardly from ends of the second horizontal beams;

c) second brackets releasably attaching a first end of each of the second horizontal beams to the connection boards of the third side post; and, d) attaching devices attaching a second end of each of the second horizontal beams to the connection boards of one of the first and second side posts.

* * * * *